US006408588B1

(12) United States Patent
Kelly

(10) Patent No.: US 6,408,588 B1
(45) Date of Patent: Jun. 25, 2002

(54) PREFABRICATED WOODEN WALL FRAMEWORK

(76) Inventor: Francis Sean Kelly, 2170 Rankintown Rd., Finleyville, PA (US) 15332

( * ) Notice: Subject to any disclaimer, the term of this patent is extended or adjusted under 35 U.S.C. 154(b) by 0 days.

(21) Appl. No.: 09/272,725

(22) Filed: Mar. 18, 1999

(51) Int. Cl.[7] ..... E04H 12/02

(52) U.S. Cl. ..... 52/653.1; 52/481.1; 52/650.1; 52/656.1; 52/664; 264/299

(58) Field of Search ..... 52/235, 474, 475.1, 52/481.1, 633, 648.1, 650.1, 653.1, 656.1, 660, 664; 264/45.1, 45.8, 166, 167, 299

(56) References Cited

U.S. PATENT DOCUMENTS

| | | | | | |
|---|---|---|---|---|---|
| 2,922,201 | A | * | 1/1960 | Baker | |
| 3,159,235 | A | * | 12/1964 | Young et al. | |
| 3,407,555 | A | * | 10/1968 | Pugh | |
| 3,897,620 | A | | 8/1975 | Wright | |
| 3,999,343 | A | * | 12/1976 | Roberts | 52/241 |
| 4,033,086 | A | | 7/1977 | Marchot | |
| 4,071,984 | A | | 2/1978 | Larrow | |
| 4,269,006 | A | | 5/1981 | Larrow | |
| 4,283,894 | A | | 8/1981 | Raty | |
| 4,483,114 | A | * | 11/1984 | Cox | 52/281 |
| 4,765,105 | A | | 8/1988 | Tissington et al. | |
| 4,817,356 | A | * | 4/1989 | Scott | 52/729 |
| 5,095,671 | A | * | 3/1992 | Mitani | 52/210 |
| 5,210,990 | A | * | 5/1993 | Kirk, Jr. | 52/664 |
| 5,274,973 | A | * | 1/1994 | Liang | 52/243 |
| 5,396,710 | A | | 3/1995 | Battaglia | |
| 5,459,966 | A | | 10/1995 | Suarez et al. | |
| 5,467,562 | A | * | 11/1995 | Holland | 52/79.1 |
| 5,531,054 | A | * | 7/1996 | Ramirez | 52/741.1 |
| 5,590,505 | A | | 1/1997 | Bogle | |
| 5,782,054 | A | * | 7/1998 | Varoglu et al. | 52/780 |
| 5,987,841 | A | * | 11/1999 | Campo | 52/648.1 |
| 6,014,843 | A | * | 1/2000 | Crumley et al. | 52/167.3 |

FOREIGN PATENT DOCUMENTS

| | | |
|---|---|---|
| WO | WO8404941 | 12/1984 |

* cited by examiner

*Primary Examiner*—Carl D. Friedman
*Assistant Examiner*—Yvonne M. Horton
(74) *Attorney, Agent, or Firm*—Clifford A. Poff

(57) ABSTRACT

A prefabricated wall framework of a wood composite for use in wall construction having an elongated header, spaced apart studs extending perpendicularly from the header, and an elongated sill plate opposite the header in which the studs are integral with the header and sill plate. The framework made from plywood, wood chips or wood particles has application in interior or exterior walls which may be either load bearing or non-load bearing.

19 Claims, 4 Drawing Sheets

PREFABRICATED WOODEN WALL FRAMEWORK

BACKGROUND OF THE INVENTION

1. Field of the Invention

The present invention relates to a prefabricated framework for use in wall construction, and more particularly to a framework made from a wood composite for use in interior or exterior walls which maybe either load bearing or non-load bearing.

2. Description of the Prior Art

The use of elongated wooden members, such as 2-by-4's in the construction of framework for walls of a structure is well established. The use of wood is desirable for such framework because of the ability to fasten other components, such as wall board, to any part of the wooden member. The use of wood in contrast to other materials also allows for easy modification in the length of the structural members.

The use of separate pieces for forming the elements of the framework, such as headers and spaced apart studs requires on-site labor for fastening the studs to the header. What is needed is a prefabricated framework of a wood composite having an elongated header which is integral with spaced apart studs extending perpendicularly from the header. An integral framework which is prefabricated would greatly reduce on-site labor by eliminating the need to fasten separate components into a frame. The use of a wood composite for the prefabricated frame would also preserve the desirable ability to fasten other components to the framework at any location of the frame.

Accordingly, it is an object of the present invention to provide a prefabricated framework for use in wall construction having an elongated header and spaced apart studs extending perpendicularly from the elongated header in which the header and studs are made from a wood composite and in which the studs are integral with the header thereby eliminating the need for on-site fastening of separate components to form the framework.

It is a further object of the present invention to provide a prefabricated framework for use in wall construction having an elongated header and spaced apart studs extending perpendicularly from the elongated header for use in interior and exterior wall construction which may be either load bearing or non-load bearing.

SUMMARY OF THE INVENTION

According to the present invention there is provided a prefabricated wall framework. The prefabricated wall framework includes an elongated header having a predetermined length to extend along a ceiling joist of a building; and an elongated stud integral with and perpendicular to said header at each of spaced apart locations, the header and each stud integral therewith comprised of a wood composite suitable for fastening to floor and ceiling joists and for supporting wall board. In the preferred form of the present invention, the framework further includes a sill plate opposite to the header which is a wood composite integral with the studs.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1A:
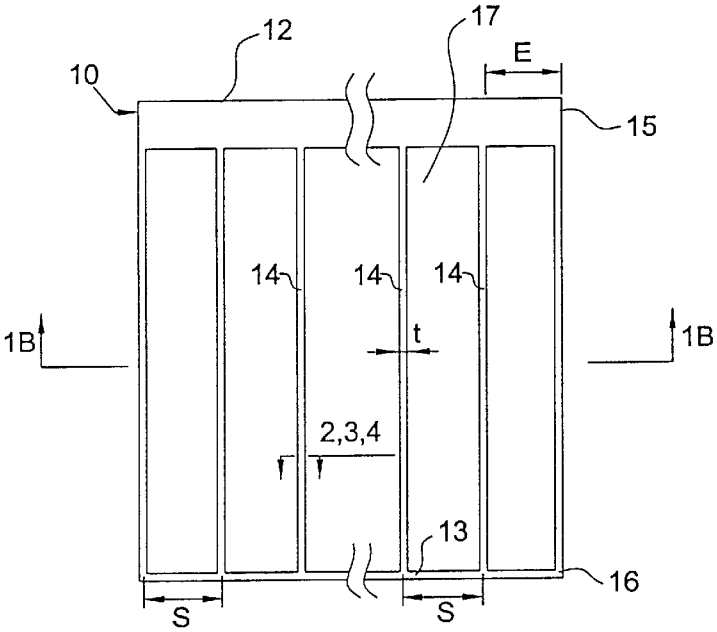
FIGS. 1A and 1C are elevational views and FIGS. 1B and 1D are sectional views, respectively, of a prefabricated wall framework according to the present invention.
Figure 1B:
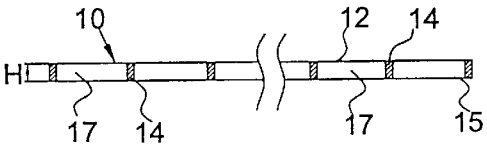
Figure 1C:
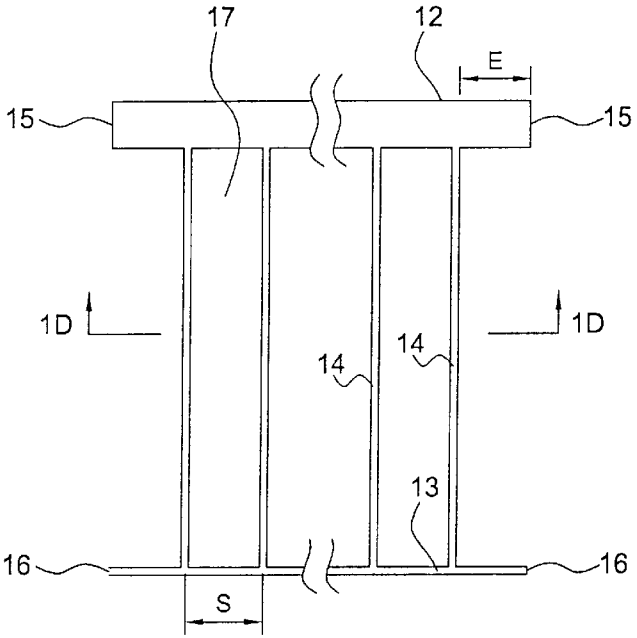

Referring to FIGS. 1A and 1B, there is shown a prefabricated wooden wall framework according to the present invention for use in interior or exterior wall construction, both load bearing and non-load bearing. The wooden framework 10 includes an elongated header 12 having a length to extend along a ceiling joist of a building and an opposite sill plate 13 having a length to extend along a floor joist. The framework 10 further includes stud members 14 extending perpendicularly with respect to the header 12, and between the header and the sill plate 13, at uniformly spaced apart locations for which the spacing, shown as S, is most preferably in accordance with established industry standards for stud spacing. The illustration of FIGS. 1A and 1B includes broken lines through header 12 and sill plate 13 to indicate that the framework 10 could be fabricated to include differing numbers of studs 14 depending upon various factors such as storage and handling considerations, for example.

Each of the header 12 and the sill plate 13 has a projecting portion 15 and 16, respectively, for connection of one prefabricated framework to another as part of an assembly of prefabricated frameworks, to be discussed in greater detail below. The projecting portions 15 and 16 extend from one of the studs 14 for a distance, shown as E, most preferably equal to 1/2 of (S-t) where t is equal to the width of the studs. In this manner, when two frameworks are joined together such that the projecting portions 15 and 16 of the frameworks abut one another, the spacing of the studs 14 will be S throughout the resulting assembly of frameworks. As seen in FIG. 1B, the framework 10 has a depth, shown as H, such that cavities 17 between the spaced apart studs 14 are sufficiently deep to accommodate utilities for a building.

Figure 4:
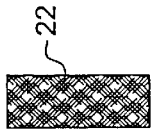
FIG. 4 is a sectional view of one of the studs of the framework of FIG. 1 in which the framework is made of wood particles molded in the form of the framework.
Figure 3:
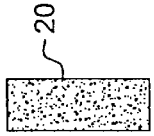
FIG. 3 is a sectional view of one of the studs of the framework of FIG. 1 in which the framework is made of wood chips molded in the form of the framework.
Figure 2:
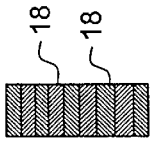
FIG. 2 is a sectional view of one of the studs of the framework of FIG. 1 in which the framework is made from plywood.

The header 12, the sill plate 13 and the studs 14 are all of a wood composite for which each of the studs of the framework 10 are integral with the header and the sill plate. Turning to FIGS. 2–4, there are illustrated cross-sectional views of one of the studs of framework 10 which is made from wood composites according to the present invention suitable for attachment of the framework to floor or ceiling joists of a building and for supporting wall board, for example. FIG. 2 illustrates a stud of a framework made of plywood having layered plies 18 in which resin between the layers binds the layers into a highly rugged composite. In FIG. 3, there is illustrated a wood chip composite 20 in which wood chips coated with a resin have been molded to form the integral framework 10. In FIG. 4, there is illustrated a wood particle composite 22 in which wood particles coated with a resin have been molded to form integral framework 10. The molded chips and particles of wood composites 20 and 22 have sufficient cohesiveness for receiving fasteners to connect the framework to floor or ceiling joists or to support wall board.

Figure 5A:
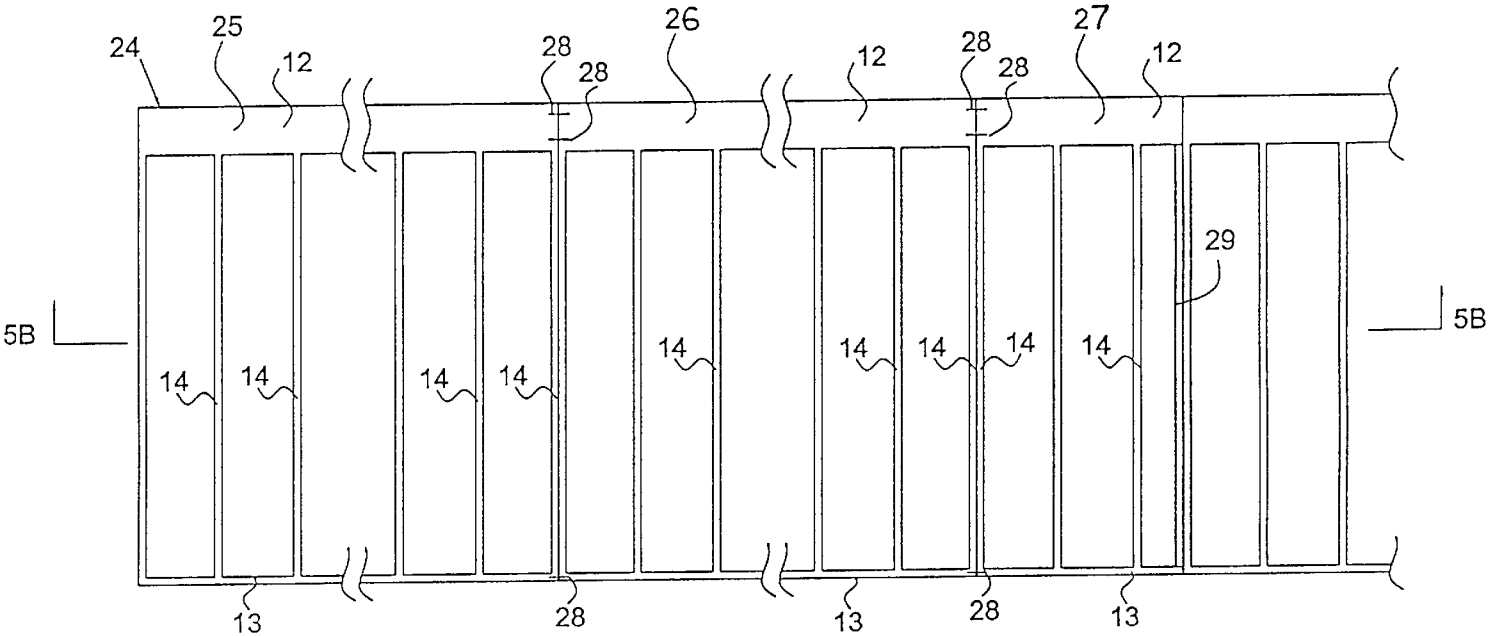
FIGS. 5A and 5B are elevational and sectional views, respectively, of a framework assembly consisting of multiple prefabricated wall frameworks according to the present invention.
Figure 5B:
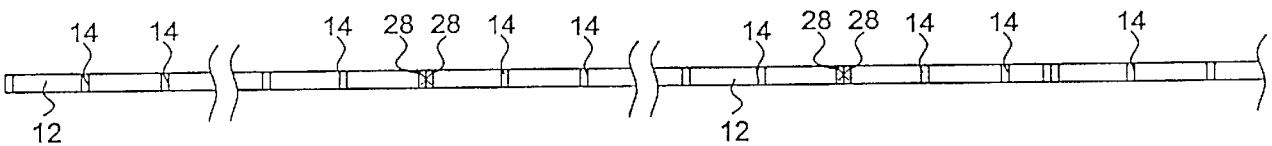

Turning to FIGS. 5A and 5B, there is illustrated a framework assembly 24 consisting of prefabricated wooden frameworks 25, 26 and 27 which have been connected by toenail fastening using nails 28 which are driven obliquely with respect to the frameworks as seen in FIG. 5B. The prefabricated frameworks 25 and 26 constructed similarly to the prefabricated framework 10 of FIGS. 1A and 1D and are connected, in the manner described previously, so that the projecting portions 15 and 16 of framework 25 abut the projecting portions of framework 26 resulting in spacing of the studs 14 equal to S along the length of the connected frameworks 25 and 26. The assembly 24 also includes prefabricated framework 27 which is a partial of prefabricated framework 10 of FIGS. 1A and 1B, resulting from sawing of framework 10 as required by the overall length of assembly which the wall requires. The partial framework 27 is shown connected to framework 26 the stud forming the terminal end of framework 27 abuts the stud forming a terminal end of framework 26. Framework 26 is connected to framework 27 in the same manner as the connection of frameworks 25 and 26 through toenail fastening by obliquely driven nails 28. A support member 29 secured in position adjacent to the ends of header 12 and sill plate 13, which have been formed through sawing of the framework, forms a terminal end of the framework assembly 24.

Figure 1D:
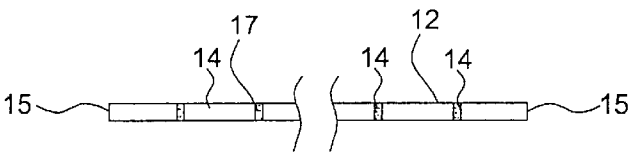
Figure 6:
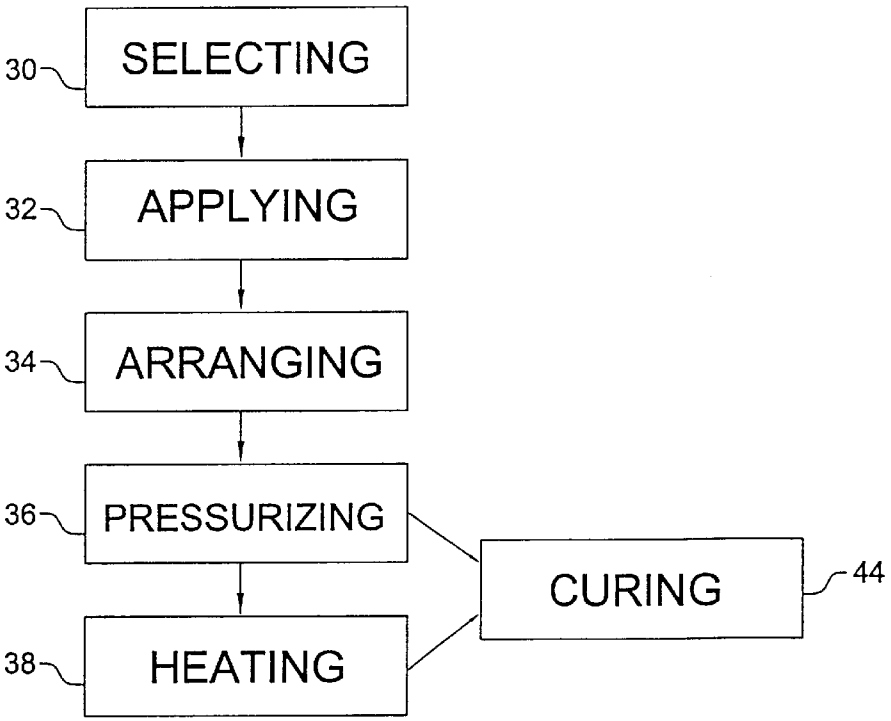
FIG. 6 is a schematic illustration of a method of forming the framework of FIG. 1.

Referring to FIG. 6, there is schematically illustrated a method of fabricating the framework of FIGS. 1A and 1D. The method includes step 30 of selecting a plurality of wooden members for use as components of the integral composite framework 10 of FIGS. 1A and 1B. For a plywood framework, unless the framework is formed by sawing a previously formed and integral section of plywood to the desired shape of the framework, the wooden members are separate plies and step 30 involves the selection of suitable plies. For wood composites 20 and 22, the wooden members are wood chips or wood particles, respectively, and step 30 involves the selection of a suitable amount chips or particles to form the integral framework accounting for space taken by a bonding agent to be described below, as well as any compaction of the wood chips or particle which may occur during the formation of the integral framework.

The method further includes step 32 of applying a bonding agent to at least a portion of the wood members which were selected in step 30. For a plywood framework, step 32 involves application of, most preferably, a resin, to the surfaces of the plies which will contact surfaces of other plies in the composite. For frameworks formed from wood composites 20 and 22, step 32, most preferably involves the application of a suitable bonding agent to the selected chips or particles, respectively, in a mixer.

Figure 7:
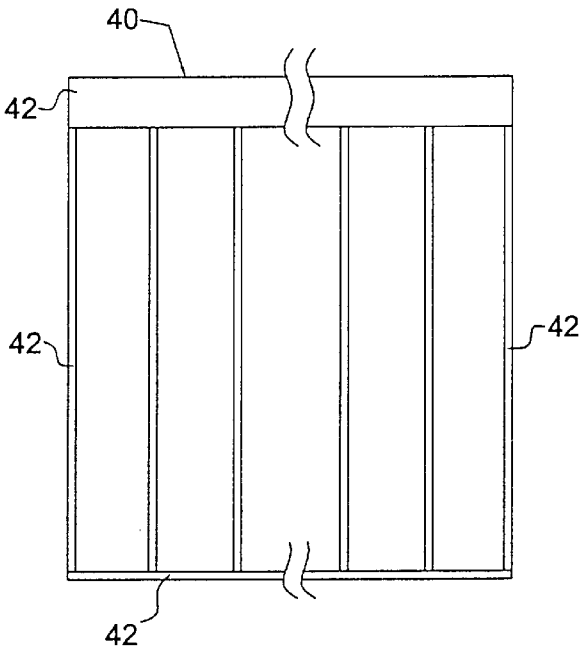
FIG. 7 is an illustration of a ply layer of a prefabricated plywood framework according to the present invention.

The method includes step 34 of arranging the selected wooden members in an arrangement having the preselected form seen in FIG. 1A having a plurality of stud sections extending from the transverse header section which is generally perpendicular to the stud sections. For a plywood framework, each of the layers 40 of selected plies could comprise separate elongated segments 42 as seen in FIG. 7. For frameworks formed from wood composites 20 and 22, step 34 involves placement of the selected wood members into a mold having the form of the desired framework of FIG. 1A.

The method further includes step 36 of pressurizing the arranged wooden members. The method also includes step 38 of heating the arranged wooden members, most preferably while pressure is being applied to the arranged wooden members in step 36. It is most preferable that the method include step 44 of curing the framework by maintaining the pressure of step 36 and the heating of step 38 for a preselected time sufficient to ensure effective bonding of the wooden members by the bonding agent applied in step 32.

While the present invention has been described in connection with the preferred embodiments of the various figures, it is to be understood that other similar embodiments may be used or modifications and additions may be made to the described embodiment for performing the same function of the present invention without deviating therefrom Therefore, the present invention should not be limited to any single embodiment, but rather construed in breadth and scope in accordance with the recitation of the appended claims.

I claim:

1. A prefabricated wall framework comprising a unitary molded wood composite defining elongated molded headers spaced apart by each of a plurality studs integrally molded with the headers at spaced apart regular intervals to extend perpendicular between the elongated lengths of the headers, said headers being suitable for fastening to floor and ceiling joints and with said studs occurring at regular intervals suitable to support a wall board to form a wall.

2. The prefabricated wall framework according to claim 1 wherein each stud and said header have a predetermined depth to form a wall structure for a building to form cavities between each of said studs having a desired depth to accommodate utilities for the building.

3. The prefabricated wall framework according to claim 2 wherein each of said headers includes an integrally molded projecting portion extending beyond a last occurring stud of said plurality of studs, and a support member secured in position adjacent to the terminal ends of the projecting portions to form a terminal end of the framework.

4. The prefabricated wall framework according to claim 1 wherein said header and stud at each of the spaced apart locations are comprised of plywood.

5. The prefabricated wall framework according to claim 4 wherein each of ply layers of said plywood comprise a plurality of elongated members.

6. The prefabricated wall framework according to claim 1 wherein said header and stud at each of the spaced apart locations are comprised of wood chips.

7. The prefabricated wall framework according to claim 1 wherein said header and stud at each of the spaced apart locations are comprised of wood particles.

8. A prefabricated wall framework comprising a plurality of unitary molded wood composites each defining elongated molded headers spaced apart by each of a plurality studs integrally molded with the headers at spaced apart regular intervals to extend perpendicular between the elongated lengths of the headers, said headers being suitable for fastening to floor and ceiling joints and with said studs occurring at regular intervals suitable to support a wall board to form a wall.

9. The prefabricated wall framework according to claim 8 wherein each stud and each of said headers have a predetermined depth to form a wall structure for a building having cavities between each of said studs of a depth sufficient to accommodate utilities for the building.

10. The prefabricated wall framework according to claim 9 wherein each of the headers of one of said plurality of unitary molded wood composites includes an integrally molded projecting portion extending beyond a last occurring stud of said plurality of studs, terminal ends of the projecting portions being suitable for fastening to the headers of a second one of said plurality of unitary molded wood composites.

11. The prefabricated wall framework according to claim 9 wherein each of said headers and stud at each of the spaced apart locations are comprised of plywood.

12. The prefabricated wall framework according to claim 11 wherein each of ply layers of said plywood comprise a plurality of elongated members.

13. The prefabricated wall framework according to claim 9 wherein each of said headers and stud at each of the spaced apart locations are comprised of wood chips.

14. The prefabricated wall framework according to claim 9 wherein each of said headers and stud at each of the spaced apart locations are comprised of wood particles.

15. The wall stud assembly according to a method of fabrication, said method including the steps of:

selecting wooden members for use as components for forming a prefabricated wall framework;

applying a bonding agent to at least a portion of each of said wooden members;

arranging said wooden members in a mold defining elongated molded headers spaced apart by each of a plurality studs with the headers at spaced apart regular intervals to extend perpendicular between the elongated lengths of the headers, said headers being suitable for fastening to floor and ceiling joints and with said studs occurring at regular intervals suitable to support a wall board to form a wall;

pressurizing the wooden members in the mold to form a unitary molded wood composite; and heating the pressurized wooden members in the mold to form a prefabricated wall framework.

16. The wall stud assembly according to claim 15 wherein said plurality of wooden members comprise ply layers in which each layer includes a plurality of elongated segments.

17. The wall stud assembly according to claim 15 wherein said plurality of wooden members comprise wood chips and said adhesive comprises a resin bond and wherein said step of arranging includes placement of said chips into a mold.

18. The wall stud assembly according to claim 15 wherein said plurality of wooden members comprise wood particles and said adhesive comprises a resin bond and wherein said step of arranging includes placement of said particles into a mold.

19. The wall stud assembly according to claim 15 wherein said steps of pressurizing and heating occur simultaneously and wherein said method includes the further step of curing said composite assembly by maintaining pressure and heat for a preselected period of time.

* * * * *